US006227543B1

(12) United States Patent
Balog et al.

(10) Patent No.: US 6,227,543 B1
(45) Date of Patent: May 8, 2001

(54) MOVIE QUOTE TRIVIA GAME

(76) Inventors: Joseph A. Balog, 10251 W. County Trunk Hwy. K, Beloit, WI (US) 53511; Brian S. Rogula, 116 N. Grant Ave., Janesville, WI (US) 53545

( * ) Notice: Subject to any disclaimer, the term of this patent is extended or adjusted under 35 U.S.C. 154(b) by 0 days.

(21) Appl. No.: 09/252,102

(22) Filed: Feb. 18, 1999

(51) Int. Cl.[7] ..... A63F 3/00

(52) U.S. Cl. ..... 273/243; 273/308; 273/300; 273/430

(58) Field of Search ..... 273/236, 242, 273/243, 429, 430, 431, 308, 432

(56) References Cited

U.S. PATENT DOCUMENTS

D. 29,998 * 1/1899 Fuertes .
D. 33,151 * 9/1900 Boggis .
589,447 * 9/1897 Strasser .
4,012,046 * 3/1977 Liket .
4,273,337 * 6/1981 Carrera .
4,359,226 * 11/1982 Neff .
5,066,016 * 11/1991 O'Neill .
5,071,132 * 12/1991 Ward .
5,121,928 * 6/1992 Salerno-Sonneberg .
5,193,818 * 3/1993 Leeson .
5,251,904 * 10/1993 Cruz .
5,360,216 * 11/1994 Counterman .
5,467,997 * 11/1995 Bashirzadeh .
5,505,456 * 4/1996 Schmidt .

* cited by examiner

*Primary Examiner*—Benjamin H. Layno
*Assistant Examiner*—Vishu Mendiratta

(57) ABSTRACT

A game is provided including a game board, a plurality of tokens, a random generator, and a plurality of cards removably positioned within the card box and each including a top face and a bottom face. The bottom face of each card having a quote thereon and an actor name who stated the quote, a movie name in which the actor stated the quote, and a character name played by the actor in the movie.

1 Claim, 3 Drawing Sheets

MOVIE QUOTE TRIVIA GAME

BACKGROUND OF THE INVENTION

1. Field of the Invention

The present invention relates to trivia games and more particularly pertains to a new movie quote trivia game for providing entertainment by attempting to guess information associated with a quote in a movie.

2. Description of the Prior Art

The use of trivia games is known in the prior art. More specifically, trivia games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,066,016; 5,735,522; 5,121,928; 4,907,808; 1,616,328; and U.S. Patent Des. 265,217.

In these respects, the movie quote trivia game according to the present invention substantially departs from the conventional concepts and designs of the prior art, and in so doing provides an apparatus primarily developed for the purpose of providing entertainment by attempting to guess information associated with a quote in a movie.

SUMMARY OF THE INVENTION

In view of the foregoing disadvantages inherent in the known types of trivia games now present in the prior art, the present invention provides a new movie quote trivia game construction wherein the same can be utilized for providing entertainment by attempting to guess information associated with a quote in a movie.

The general purpose of the present invention, which will be described subsequently in greater detail, is to provide a new movie quote trivia game apparatus and method which has many of the advantages of the trivia games mentioned heretofore and many novel features that result in a new movie quote trivia game which is not anticipated, rendered obvious, suggested, or even implied by any of the prior art trivia games, either alone or in any combination thereof.

To attain this, the present invention generally comprises a game board having a substantially planar square configuration including a top face, a bottom face and a periphery formed therebetween. The top face has a path situated thereon along the periphery thereof. The path is defined by a four linear portions each including a plurality of linearly aligned substantially square spaces. Each space of the linear portions of the path each has a diagonal dividing the same into a pair of substantially triangular sections. Such triangular sections include a first section of a first color and a second section of a second color. Note FIG. 1. As shown, the path is further defined by four corner portions each including a substantially square space. Each space of three of the corner portions of the path has two diagonals a first one of which divides the same into a pair of substantially triangular sections. Such triangular sections include a first section of a first color and a second section of a second color. A second one of triangular sections divides the associated corner portion into four triangular sections. A remaining one of the corner portions has "START" and "FINISH" indicia therein with remaining spaces each having a unique numeral positioned in each of the sections therein. As shown in FIG. 1, the numerals are positioned in sequential order. For reasons that will soon become apparent, the top face of the game board further includes a pair of diametrically opposed substantially rectangular card places each having one of the colors. Ideally, a plurality of the sections has either point docking indicia therein, point awarding indicia therein, indicia indicating a number of spaces to be moved ahead, indicia indicating a number of spaces to be moved back, or bonus indicia. A chart delineating which spaces have such indicia is provided hereinbelow. While not shown, the present invention further includes a plurality of tokens, a timer for indicating the cessation of a predetermined amount of time, and a die or any other random number generator. FIG. 2 shows a card box including a bottom face with a substantially planar rectangular configuration with a side coupled to a periphery of the bottom face. As such, an interior space and an open top are defined. Finally, a plurality of cards are removably positioned within the card box and each including a top face with at least one of the first color and the second color. As shown in FIG. 3, each card further includes a bottom face having a quote thereon. Also positioned on the bottom face of each card is an actor name who stated the quote, a movie name in which the actor stated the quote, and a character name played by the actor in the movie. The bottom face further indicates a first number of points awarded for guessing each of the names, a second number of points awarded for guessing two of the names, and a third number of point awarded for guessing one of the names. Ideally, 10 points are awarded for guessing three names, 7 points are awarded for guessing two names, and 5 points are awarded for guessing one name.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new movie quote trivia game apparatus and method which has many of the advantages of the trivia games mentioned heretofore and many novel features that result in a new movie quote trivia game which is not anticipated, rendered obvious, suggested, or even implied by any of the prior art trivia games, either alone or in any combination thereof.

It is another object of the present invention to provide a new movie quote trivia game which may be easily and efficiently manufactured and marketed.

It is a further object of the present invention to provide a new movie quote trivia game which is of a durable and reliable construction.

An even further object of the present invention is to provide a new movie quote trivia game which is susceptible of a low cost of manufacture with regard to both materials and labor, and which accordingly is then susceptible of low prices of sale to the consuming public, thereby making such movie quote trivia game economically available to the buying public.

Still yet another object of the present invention is to provide a new movie quote trivia game which provides in the apparatuses and methods of the prior art some of the advantages thereof, while simultaneously overcoming some of the disadvantages normally associated therewith.

Still another object of the present invention is to provide a new movie quote trivia game for providing entertainment by attempting to guess information associated with a quote in a movie.

Even still another object of the present invention is to provide a new movie quote trivia game that includes a game board, a plurality of tokens, a random generator, and a plurality of cards removably positioned within the card box and each including a top face and a bottom face. The bottom face of each card having a quote thereon and an actor name who stated the quote, a movie name in which the actor stated the quote, and a character name played by the actor in the movie.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
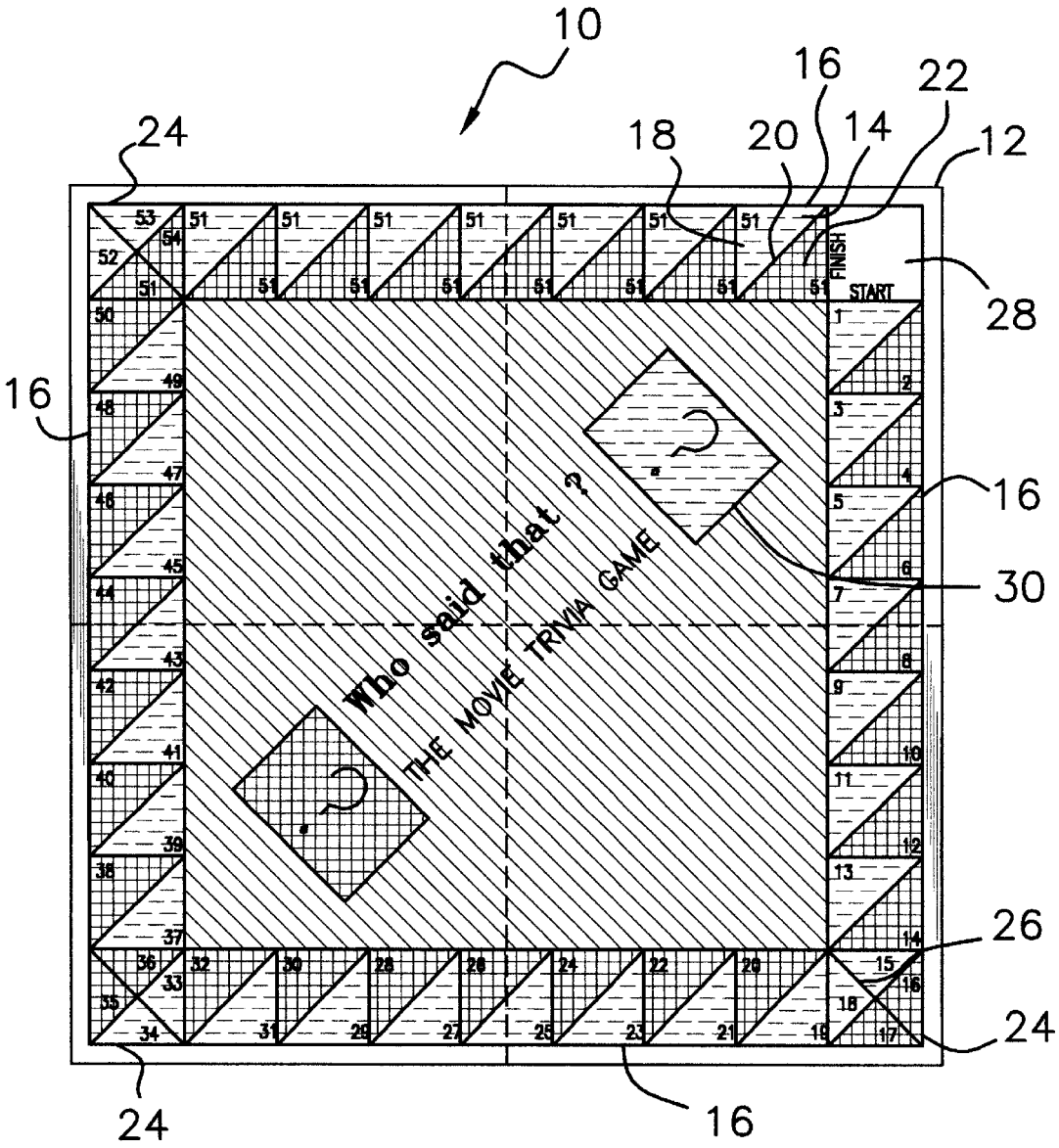
FIG. 1 is a top plan view of a new movie quote trivia game according to the present invention.
Figure 2:
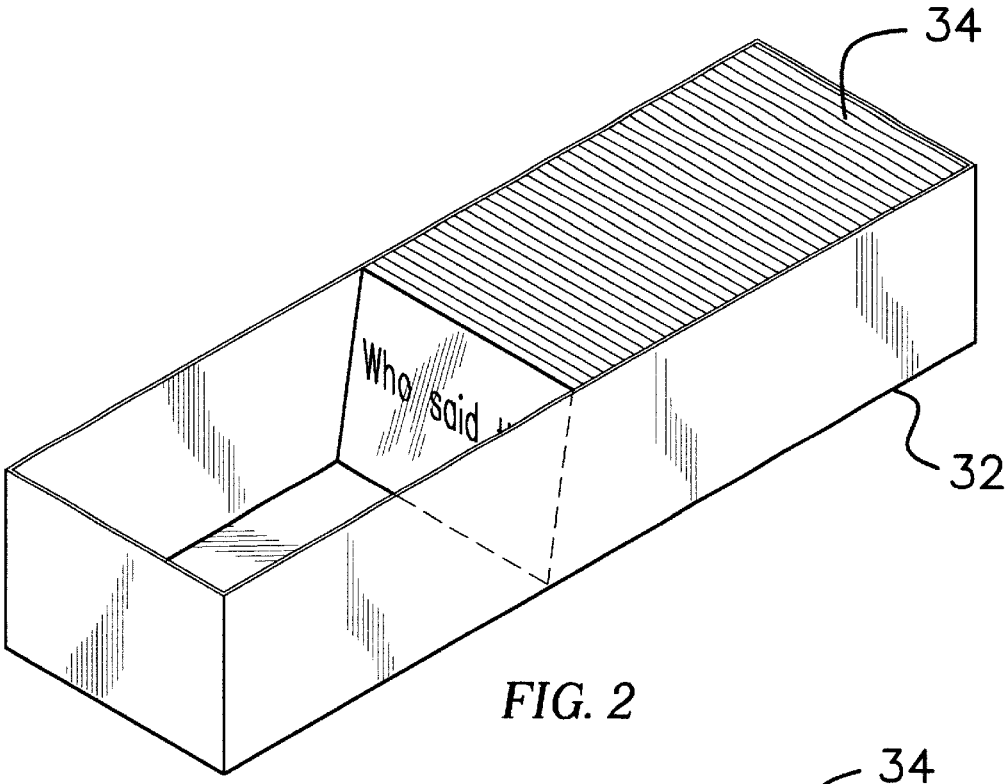
FIG. 2 is a perspective view of the playing cards and associated card box of the present invention.
Figure 3:
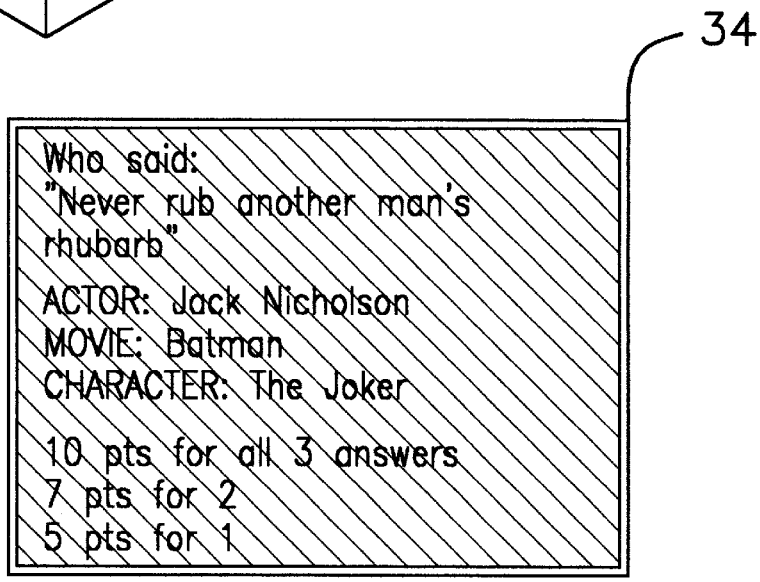
FIG. 3 is an illustration of the bottom face of the cards of the present invention.
Figure 4:
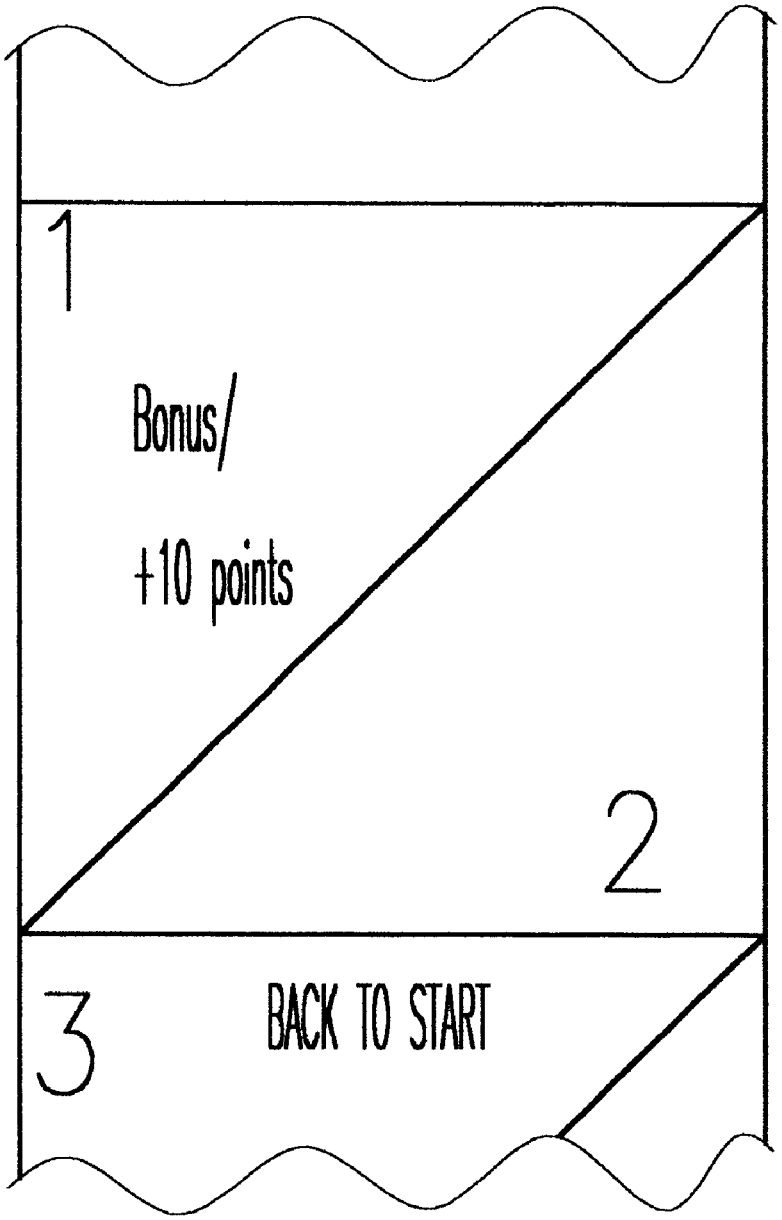
FIG. 4 is a top view of a portion of the game path of the present invention and particularly illustrating the indicia marked on the path.

With reference now to the drawings, and in particular to FIGS. 1 through 3 thereof, a new movie quote trivia game embodying the principles and concepts of the present invention and generally designated by the reference numeral 10 will be described.

The present invention, designated as numeral 10, includes a green foldable game board 12 having a substantially planar square configuration including a top face, a bottom face and a periphery formed therebetween. The top face has a path 14 situated thereon along the periphery thereof. The path is defined by a four linear portions 16 each including a plurality of linearly aligned substantially square spaces 18. Each space of the linear portions of the path each has a diagonal 20 dividing the same into a pair of substantially triangular sections 22. Such triangular sections include a first section of a first color(gold) and a second section of a second color(silver). Note FIG. 1.

As shown, the path is further defined by four corner portions each including a substantially square space 24. Each space of three of the corner portions of the path has two diagonals 26 a first one of which divides the same into a pair of substantially triangular sections. Such triangular sections include a first section of a first color and a second section of a second color. A second one of triangular sections divides the associated corner portion into four triangular sections.

A remaining one 28 of the corner portions has "START" and "FINISH" indicia therein with remaining spaces each having a unique numeral positioned in each of the sections therein. As shown in FIG. 1, the numerals are positioned in sequential order. For reasons that will soon become apparent, the top face of the game board further includes a pair of diametrically opposed substantially rectangular card places 30 each having one of the colors.

Ideally, a plurality of the sections has either point docking indicia therein, point awarding indicia therein, indicia indicating a number of spaces to be moved ahead, indicia indicating a number of spaces to be moved back, or bonus indicia. Some of the sections are blank. A chart delineating which spaces have such indicia is provided hereinbelow.

| Space | Indicia |
|---|---|
| 1) | bonus / +10 points |
| 3) | back to start |
| 5) | bonus / +10 points |
| 6) | back 5 spaces |
| 7) | back to start |
| 8) | back 3 spaces |
| 9) | bonus |
| 13) | bonus |
| 14) | back to start |
| 15) | +10 points |
| 16) | −5 points |
| 18) | back 5 spaces |
| 19) | back 4 spaces |
| 20) | bonus |
| 22) | back 3 spaces |
| 24) | bonus |
| 28) | bonus |
| 31) | ahead 3 spaces |
| 32) | bonus |
| 34) | −10 points |
| 35) | +5 points |
| 37) | bonus |
| 41) | bonus |
| 45) | bonus |
| 49) | bonus |
| 50) | ahead 4 spaces |
| 53) | +5 points |
| 54) | −10 points |
| 56) | bonus |

-continued

| Space | Indicia |
|---|---|
| 58) | ahead 2 spaces |
| 60) | bonus |
| 61) | back 3 spaces |
| 64) | bonus |
| 67) | −5 points |
| 68) | +5 points |

While not shown, the present invention further includes a plurality of tokens, a timer for indicating the cessation of a predetermined amount of time of 3 minutes, and a die or any other random number generator.

FIG. 2 shows a card box 32 including a bottom face with a substantially planar rectangular configuration with a side coupled to a periphery of the bottom face. As such, an interior space and an open top are defined.

Finally, a plurality of cards 34 are removably positioned within the card box and each including a top face with at least one of the first color and the second color. As shown in FIG. 3, each card further includes a bottom face having a quote thereon. Also positioned on the bottom face of each card is an actor name who stated the quote, a movie name in which the actor stated the quote, and a character name played by the actor in the movie. The bottom face further indicates a first number of points awarded for guessing each of the names, a second number of points awarded for guessing two of the names, and a third number of point awarded for guessing one of the names. Ideally, 10 points are awarded for guessing three names, 7 points are awarded for guessing two names, and 5 points are awarded for guessing one name. As an option, the awarded points indicated by the cards of the first color are greater than those indicated by the cards of the second color.

The method associated with the present invention first includes providing each of the foregoing components. Ideally, the cards of the first and second color are positioned in the rectangular card place of the associated color. Thereafter, an order of taking turns is determined employing the die.

During play, a plurality of players take turns between a plurality of players. Each of the turns includes a plurality of steps first including moving an associated token a number of adjacent sections on the game layout based on a number indicated by the random number generator. Upon landing on the designated section, the aforementioned indicia is read if present thereon and instructions are followed. If the section of the game board has bonus indicia thereon, a card is picked from either of the rectangular card places on the game board based on the color of the section on which the token currently resides. As an option, cards may be picked at each space in addition to following instructions on the space and/or picking an additional card as a "bonus" card.

When the cards are picked, the quote thereon is read by an adjacent player. The present player must then guess the actor name who stated the quote, the movie name in which the actor stated the quote, and the character name played by the actor in the movie within the predetermined amount of time. Points are thereafter awarded in a manner indicated by the card. As an option, points may be docked upon giving a wrong answer. Finally, a winner is declared as the player awarded a greatest amount of points after traversing all of the spaces of the game board. In an alternate embodiment, the method associated with the present invention may be carried out on a computer or any other electronic device. Further, various versions may be provided for different age groups.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A game comprising, in combination:

a game board having a substantially planar square configuration including a top face, a bottom face and a periphery formed therebetween, the top face having a path situated thereon along the periphery thereof, the path being defined by a four linear portions each including a plurality of linearly aligned substantially square spaces each having a diagonal dividing the same into a pair of substantially triangular sections including a first section of a first color and a second section of a second color, the path being defined by four corner portions each including a substantially square space, three of the corner portions having two diagonals a first one of which divides the same into a pair of substantially triangular sections including a first section of a first color and a second section of a second color and a second one of which divides the associated corner portion into four triangular sections, a remaining corner portion having "START" and "FINISH" indicia therein with remaining spaces each having a unique numeral positioned in each of the sections therein, a plurality of the sections having at least one of point docking indicia therein, point awarding indicia therein, indicia indicating a number of spaces to be moved ahead, and indicia indicating a number of spaces to be moved back, wherein the numerals are positioned in sequential order, the top face of the game board further including a pair of diametrically opposed substantially rectangular card places each having one of the colors;

a plurality of tokens;

a timer for indicating the cessation of a predetermined amount of time;

a die;

a card box including a bottom face with a substantially planar rectangular configuration with a side coupled to a periphery of the bottom face for defining an interior space and an open top; and a plurality of cards removably positioned within the card box and each including a top face with at least one of the first color and the second color such that the color of the space occupied by a player determines the color of the card to be used by the player, each card further including a bottom face having a quote thereon, an actor name who stated the quote, a movie name in which the actor stated the quote, and a character name played by the actor in the movie, the bottom face further having a first number of points awarded for guessing each of the names, a second number of points awarded for guessing two of the names, and a third number of point awarded for guessing one of the names.

* * * * *